US011834136B2

(12) United States Patent
McCartney et al.

(10) Patent No.: US 11,834,136 B2
(45) Date of Patent: Dec. 5, 2023

(54) WATERCRAFT STORAGE SYSTEM

(71) Applicant: PREMIER ACQUISITION COMPANY, LLC, Elk River, MN (US)

(72) Inventors: Charles Robert McCartney, Maple Grove, MN (US); Weston Kelly DeMorrett, Harris, MN (US)

(73) Assignee: Premier Acquisition Company, LLC, Elk River, MN (US)

( * ) Notice: Subject to any disclaimer, the term of this patent is extended or adjusted under 35 U.S.C. 154(b) by 279 days.

(21) Appl. No.: 17/092,259

(22) Filed: Nov. 7, 2020

(65) Prior Publication Data

US 2021/0139110 A1 May 13, 2021

Related U.S. Application Data

(60) Provisional application No. 62/933,242, filed on Nov. 8, 2019.

(51) Int. Cl.

| | |
|---|---|
| ***B63B 19/14*** | (2006.01) |
| ***B63B 27/16*** | (2006.01) |
| ***B63B 25/00*** | (2006.01) |
| ***B66F 7/06*** | (2006.01) |

(52) U.S. Cl.

CPC ..... *B63B 27/16* (2013.01); *B63B 19/14* (2013.01); *B63B 25/004* (2013.01); *B66F 7/065* (2013.01); *B66F 2700/09* (2013.01)

(58) Field of Classification Search

CPC .. B60P 1/02; B66F 7/0666; B66F 7/08; B66F 7/065; B66F 2700/09; B63B 2041/006; B63B 2043/145; B63B 39/02; B63B 43/08; B63B 43/14; B63B 25/004; B63B 19/14; B63B 27/16

See application file for complete search history.

(56) References Cited

U.S. PATENT DOCUMENTS 2,937,003 A * 5/1960 Croll ..... B66F 3/22 92/61
5,975,002 A * 11/1999 Rieger ..... B63B 25/002 114/343
6,782,841 B2 * 8/2004 Esposito ..... B63B 29/02 114/189

(Continued)

FOREIGN PATENT DOCUMENTS

CN 205952248 U * 2/2017
WO WO-2014199314 A2 * 12/2014 ..... B63B 23/30

*Primary Examiner* — Gregory W Adams

(74) *Attorney, Agent, or Firm* — Winthrop & Weinstine, P.A.; Alicia Griffin Mills; Nadeem W. Schwen

(57) ABSTRACT

A watercraft storage system for storing and concealing items on watercraft, which includes a suspendable shelf extending downwardly from and attaching to a select portion of the floorboard and connecting to a pair of end caps to form a containment enclosure for housing therewithin a scissor lift configured with an upper platform connecting to a base platform by a pair of moveable supports. A linear actuator connecting to the base platform and a lower forward shaft of the scissor lift operably sets in motion the moveable supports to lift and lower the upper platform relative to the base platform to respectively receive and store items temporarily below the floorboard so as to maintain continuity of the walkways associated with the watercraft.

14 Claims, 11 Drawing Sheets

(56) References Cited

U.S. PATENT DOCUMENTS

| | | | | |
|---|---|---|---|---|
| 6,880,480 | B2 * | 4/2005 | Clouse | A01K 97/06 114/343 |
| 7,997,220 | B1 * | 8/2011 | Beal | B63B 3/00 114/65 R |
| 9,963,081 | B1 * | 5/2018 | Taylor | B66F 7/08 |
| 2016/0039647 | A1 * | 2/2016 | Katerberg | B66F 7/20 254/93 L |

* cited by examiner

WATERCRAFT STORAGE SYSTEM

CROSS-REFERENCE TO RELATED APPLICATIONS

This application claims the benefit of U.S. Provisional Application No. 62/933,242, filed Nov. 8, 2019, entitled "Watercraft Storage System," the disclosures of which, including all attached documents, are incorporated herein by reference in their entirety for all purposes.

FIELD OF THE INVENTION

The present invention is generally directed to supplementing watercraft with a storage system that furthers convenience and safety during operation of the watercraft. More specifically, the watercraft storage system fully integrates within the structure of the watercraft without unduly compromising its structural integrity and offers convenient and ready access to stowed contents by way of automated-controlled components.

BACKGROUND OF THE INVENTION

Recreational boating is a popular pastime in many parts of the world. Some seek operation of watercraft on a body of water for the unrestricted nature and freedoms of traveling on the open waters. Some say it can engage one to relax and free the mind. On the other end of the spectrum, watercraft may be associated with a work function, such as those that are categorically directed to patrolling the waterways for monitoring nature's resources or policing other operational watercraft, for example. Regardless of the primary purpose of their intended use, whether it be recreational or work-functional, most types of watercraft offer little to no spatial area for accommodating storage of contents onboard, particularly larger, heavily-weighted items such as full-sized coolers and the like. Although efforts have been made in the art toward devising storage space within the limited confines of the watercraft, they may not necessarily or always offer ample storage capacity and/or convenient accessibility.

For example, some watercraft may make limited use of the bow for storage, since in most cases is ineffectual for any other purpose but perhaps small gear such as an anchor, fishing equipment and the like, while the port side and starboard may integrate wall panels to form walled cavities that may ultimately serve as compartmentalized storage spaces, albeit generally being very limited at best in terms of spatial capacity for larger, heavily-weighted items. In yet other aspects of forming storage space, the space under seats or the seat itself may equally accommodate or suffice as adequate storage space to some extent, but may perhaps lend to disruption to the seat's occupant when access to stowed content is needed or desirable from time to time, possibly compromising one's safety if the watercraft is in moving operation.

Accordingly, there remains a need for a simple, yet cost effective watercraft storage system that fully integrates within the structure of the watercraft and possesses sufficient functionality to stow larger items or heavily-weighted content that may otherwise lack accommodation within the context of dedicated storage space generally devised and recognized in the art to date for watercraft.

BRIEF SUMMARY OF THE INVENTION

In order to overcome the numerous drawbacks apparent in the prior art, a watercraft storage system has been devised for structural integration within the varied forms of watercraft offered in the art, such as pleasure, recreational watercraft in the nature of pontoons, hulled boats and the like.

It is an object of the present invention to provide a watercraft storage system that incorporates within its structure automated-controlled components to effect ready retrieval of and convenient access to stowed items or content.

It is a further object of the present invention to provide a watercraft storage system that is relatively simple in terms of design and construction and makes further or expanded use of the floats or tubes associated with pontoons or hulls of hulled boats, for example.

It is yet another object of the present invention to provide a watercraft storage system that exist below the floorboard of the watercraft insofar to maintain continuity and unrestricted use of the walkways defined within the watercraft's designed layout.

It is a further object of the present invention to provide a watercraft storage system that fulfills to accommodate storage of and offer ready access to heavily-weighted stowed items or content that may otherwise require occupation of the limited space relatively offered about the watercraft's floorboard.

It is yet a further object of the present invention to provide a watercraft storage system that considers safety in regard to the watercraft's occupants by mitigating occurrences of injury in situations of retrieving and lifting heavily-weighted, stowed items from time to time during watercraft operation.

In accordance with the present invention a watercraft storage system has been devised for use with varied forms of watercraft having a floorboard, the watercraft storage system in particular comprising a suspendable shelf having a flange for attaching to a select portion of the floorboard and housing a scissor lift having an upper platform connecting to a base platform by way of a pair of moveable supports, the scissor lift further having a linear actuator for raising and lowering the upper platform relatively above the base platform to respectively receive and store items within a containment enclosure largely formed by a pair of end caps adaptably attaching to the suspendable shelf, wherein the containment enclosure is made accessible by way an accessible panel fitted within a panel frame integrated into the floorboard, particularly as such to reside relatively flush therewith to yield continuity of the walkways particularly associated with the watercraft's designed layout.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a watercraft storage system that is structurally adaptive to varied forms of watercraft and offers to accommodate storage of heavily-weighted content that may otherwise require placement relatively about the watercraft's spatially-limited floorboard.

Figure 1:
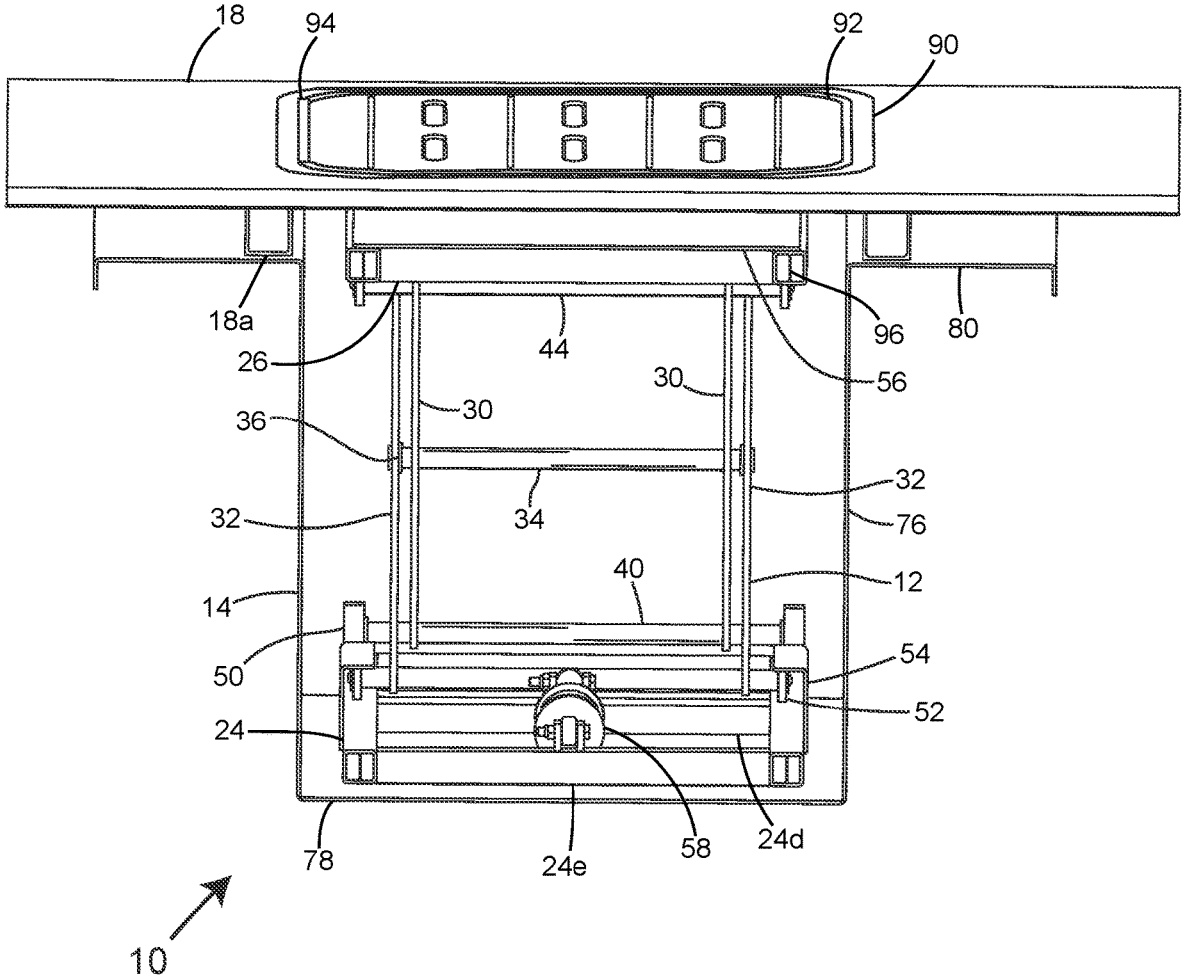
FIG. 1 is a front perspective view of the preferred embodiment of the present invention illustrating a suspendable shelf supporting and containing a scissor lift and being suspended from a representative section of floorboard associated with watercraft.
Figure 2:
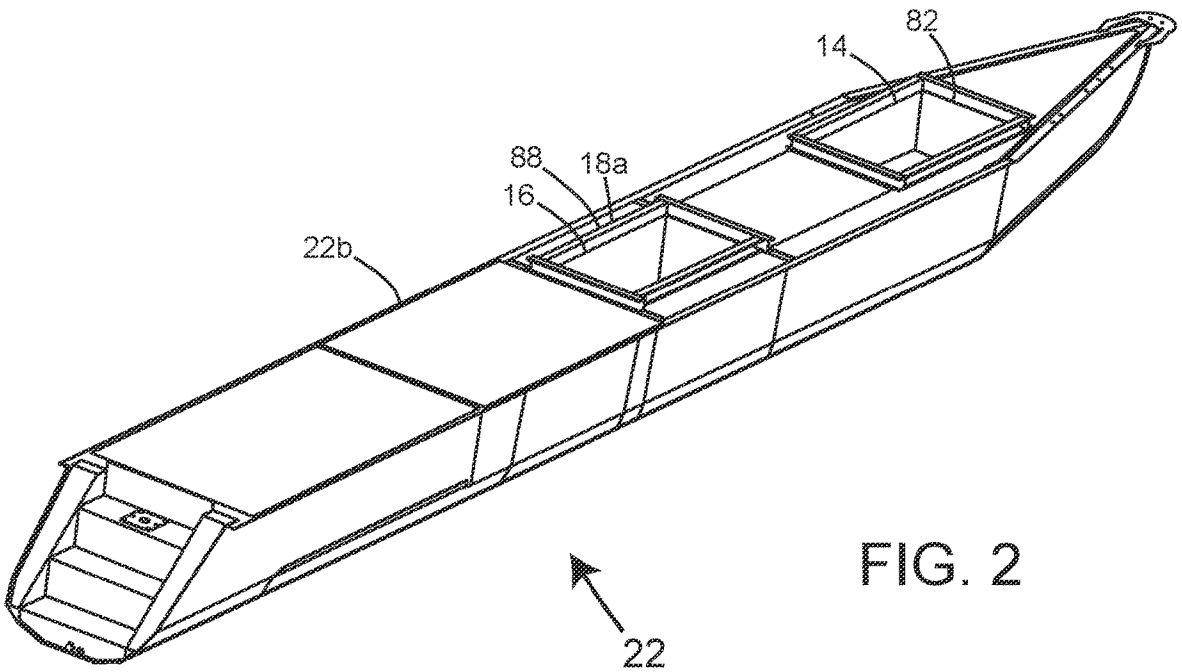
FIG. 2 is a perspective view of the preferred embodiment of the present invention illustrating a float typically associated with a pontoon.

Referring now to FIG. 1, there is shown generally at 10 a watercraft storage system comprising a scissor lift 12 housed within a containment enclosure 14 formed in part by a suspendable shelf 16 largely extending downwardly from and connecting to a floorboard 18 commonly associated with watercraft 20. It is understood within the context of this disclosure that the watercraft storage system may be incorporated within varied forms of watercraft that structurally include a floorboard 18 supported by cross beams 18*a* and like structure to form a bottom space 18*b* thereunder for accommodating the spatial requirements of the suspendable shelf, such as within a float 22 of a pontoon or a hull of a boat or ship. For example, FIGS. 2 and 3 exemplify typical placement of the watercraft storage system 10 within the spatial confines of the bottom space offered interiorly within a centralized float 22 associated with a pontoon having a tri-float configuration.

As generally shown in FIGS. 4-9, the scissor lift 12 is preferentially configured with a base platform 24 connecting to an upper platform 26 by way of a pair of moveable supports 28. It is understood that additional pairs of moveable supports in a connective stacked arrangement may be utilized to establish an increased range of height for some applications requiring enhanced storage capacity.

Figure 4:
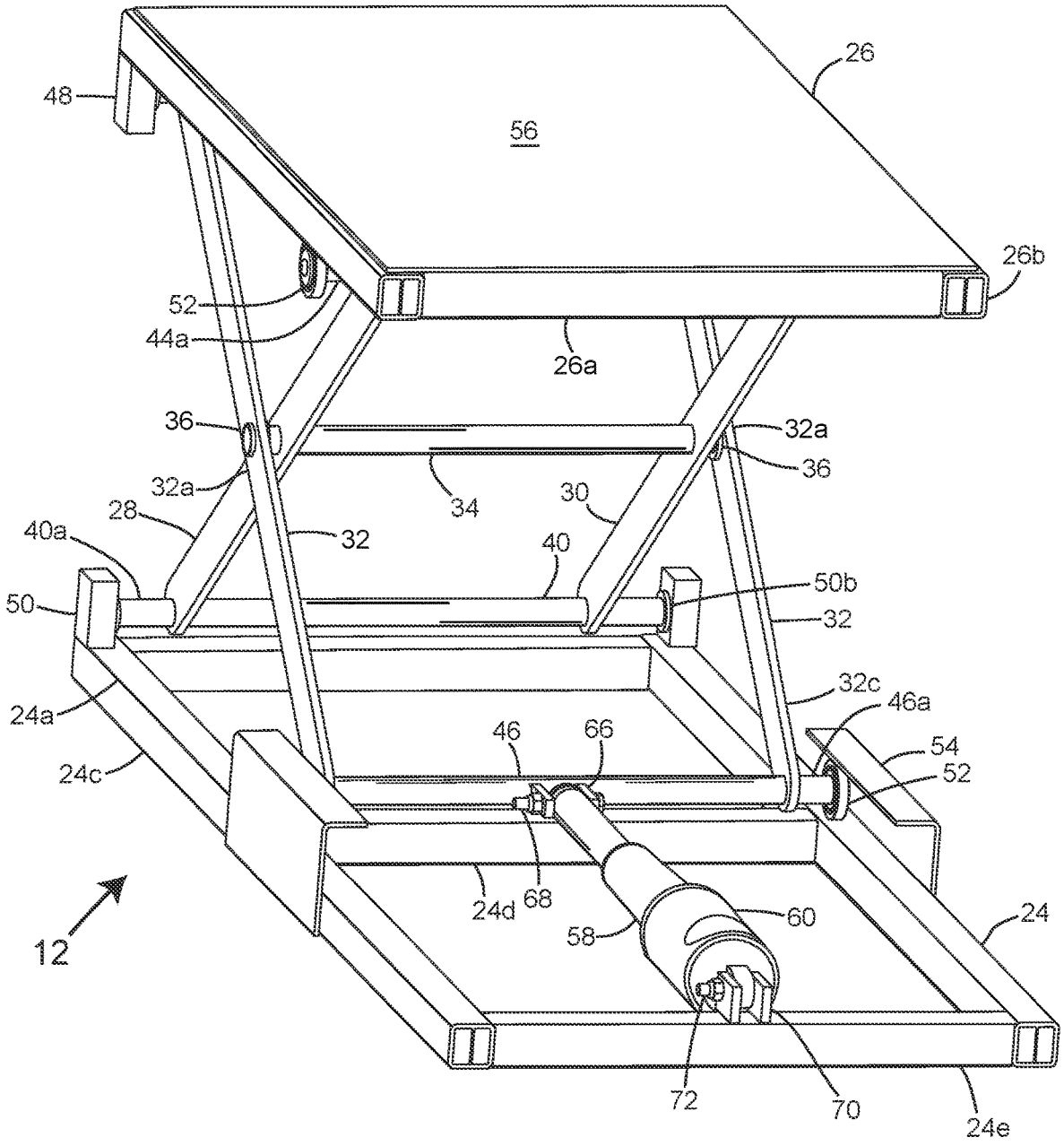
FIG. 4 is a front perspective view of the preferred embodiment of the present invention illustrating a scissor lift having an upper platform in an uppermost position relative to a base platform.
Figure 5:
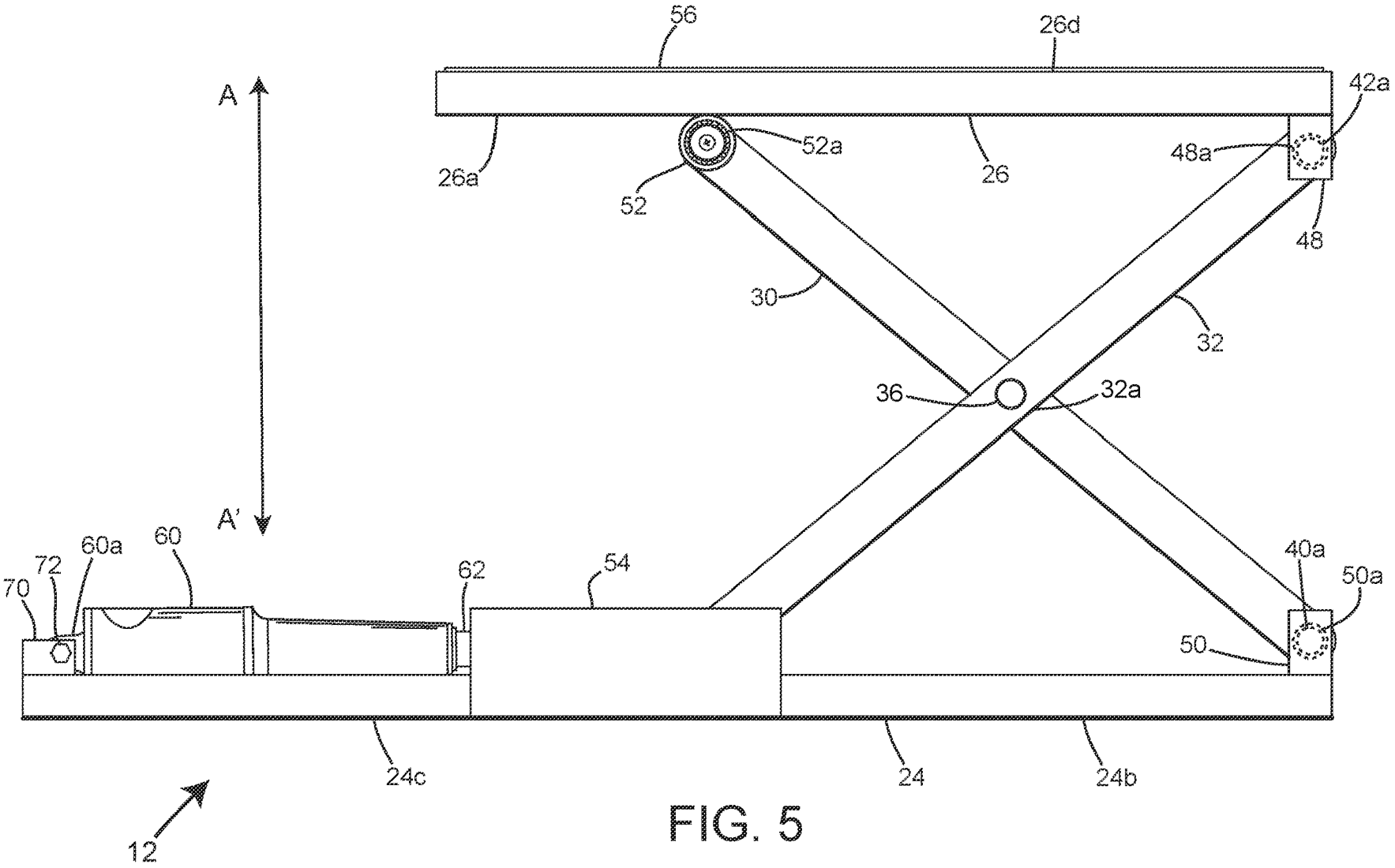
FIG. 5 is a right-side elevational view of the preferred embodiment of the present invention illustrating a linear actuator and an upper platform situated above and being connected to a base platform by way of a pair of moveable supports.
Figure 6:
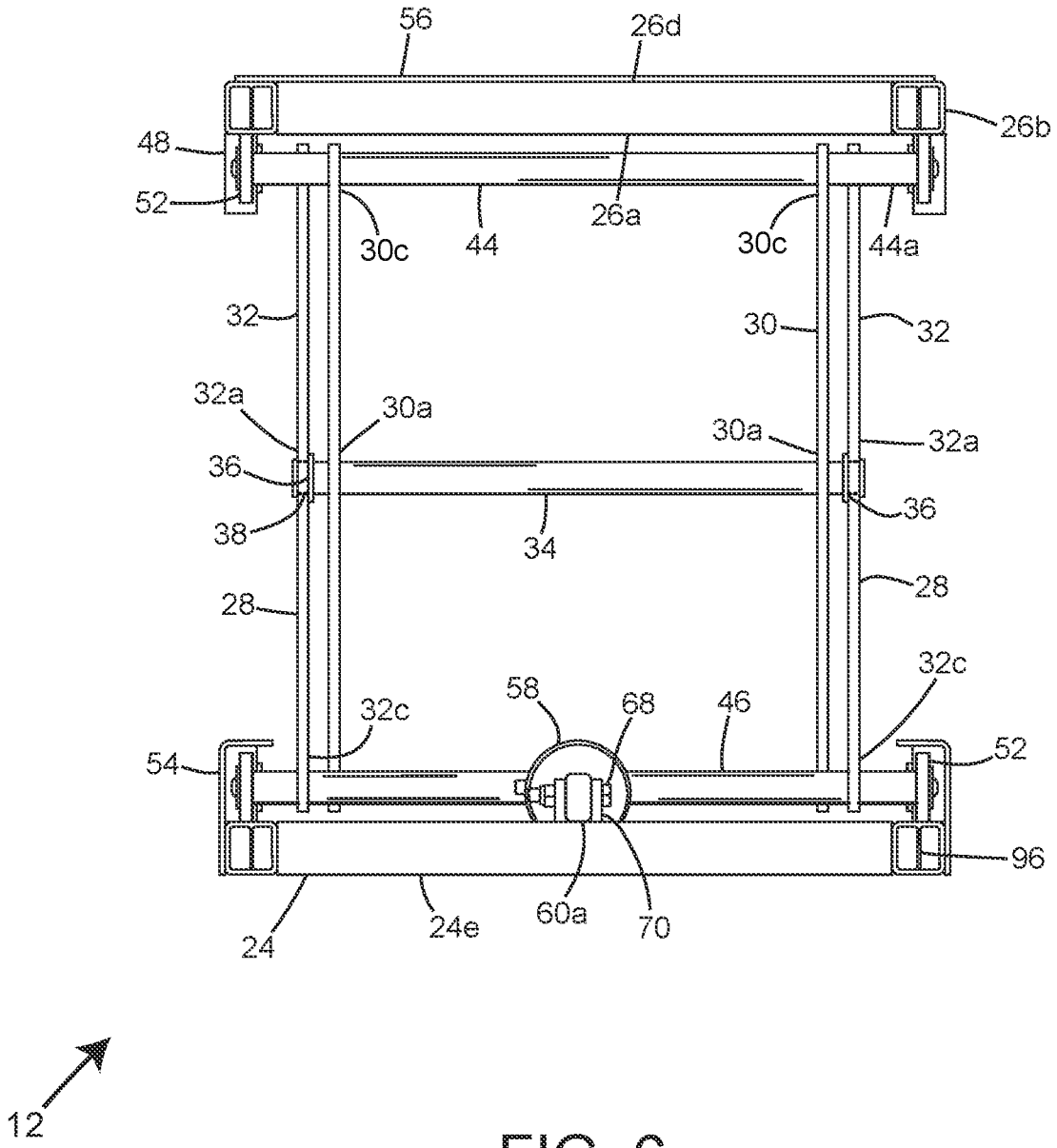
FIG. 6 is a front elevational view of the preferred embodiment of the present invention illustrating a scissor lift having a pair of moveable supports and a linear actuator having an eyelet end attached to a pair of flanges.

In reference to FIGS. 4 and 6, each pair of moveable supports comprises an innermost cross member 30 and an outermost cross member 32 with each respectively having a midpoint position 30*a*, 32*a* engaging a supportive cross rod 34. In particular, the midpoint position 30*a* of each of the innermost cross members is generally shown in FIG. 6 as being fixedly attached to the supportive cross rod, whereas the midpoint position 32*a* of each of the outermost cross members 32 pivotally connect to the supportive cross rod and generally accommodate a bushing 36 press-fitted into an aperture 38 extending through the outermost cross member to assist in unrestricted rotation thereabout.

Figure 7:
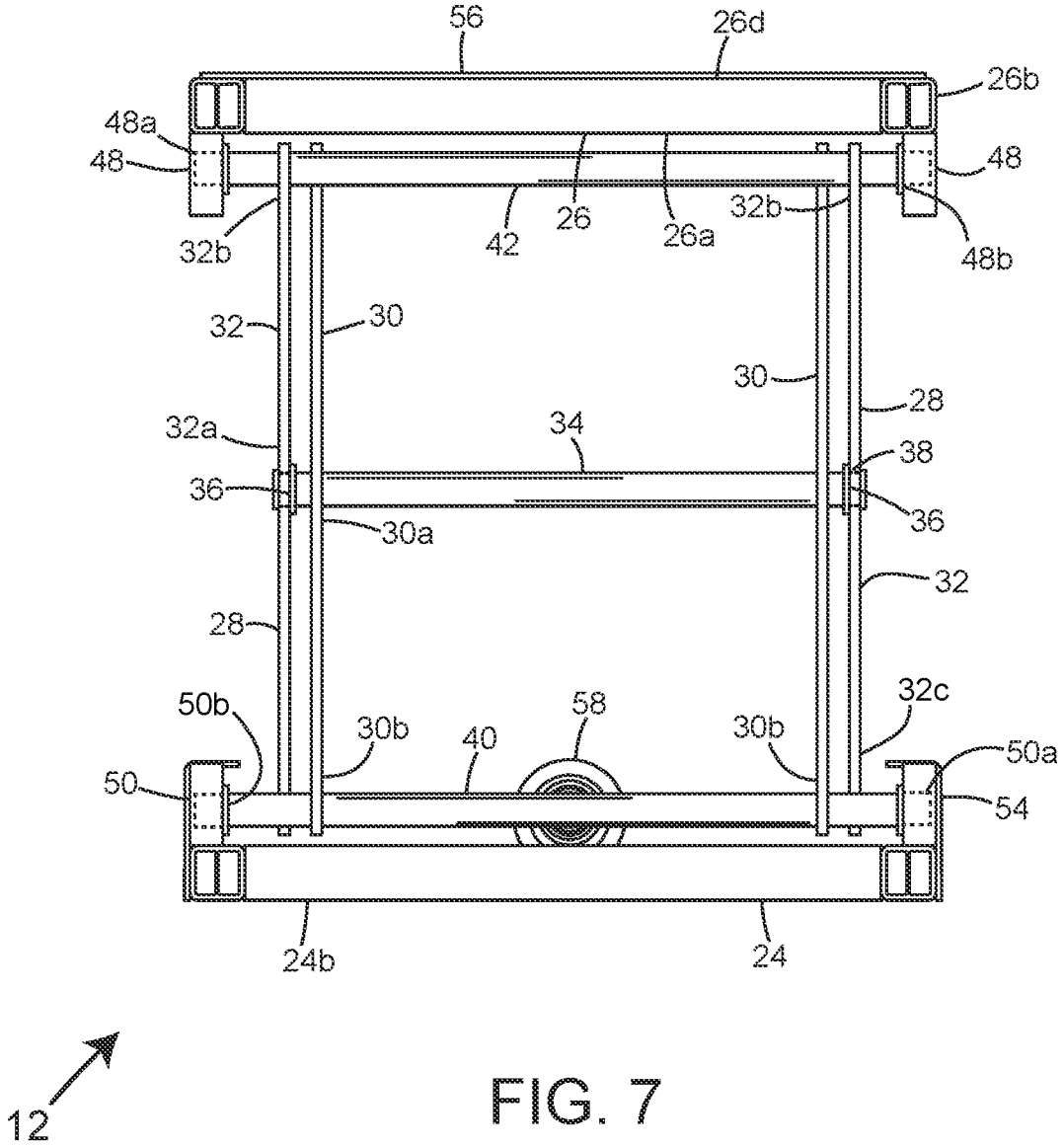
FIG. 7 is a rear elevational view of the preferred embodiment of the present invention illustrating a pair of moveable supports being connected to one another in part by a lower end shaft, an upper end shaft, and a supportive cross rod.

As further depicted in FIGS. 6 and 7, the innermost and outermost cross members each comprise a first end 30*b*, 32*b* being respectively attached to a lower end shaft 40 and an upper end shaft 42 and a second end 30*c*, 32*c* being respectively attached to an upper forward shaft 44 and a lower forward shaft 46. To enable rotation of the upper and lower end shafts that consequently contribute in raising and lowering the upper platform, ends 42*a* of the upper end shaft 42 are generally shown in FIG. 7 as being slidably fitted into cylindrical bores 48*a* associated with a pair of downward mounts 48 connecting to and extending downwardly from the upper platform 26, whereas ends 40*a* of the lower end shaft 40 are generally shown therein as being slidably fitted into cylindrical bores 50*a* associated with a pair of upward mounts 50 connecting to and extending upwardly from the base platform 24. To facilitate ease by which the upper and lower end shafts rotate within the cylindrical bores while mitigating occurrences of premature wear thereat, each cylindrical bore as associated with the downward and upward mounts is preferentially press-fitted with a bushing 48*b*, 50*b* of the type commonly available in the art for such applications. Comparatively, ends 44*a*, 46*a* of the upper and lower forward shafts each receive a wheel 52 that functionally fulfill to roll and traverse respectively about a bottom side 26*a* of a framed portion 26*b* of the upper platform 26 and a top side 24*a* of a framed portion 24*b* of the base platform 24 simultaneously while the upper platform vertically travels away from and moves toward the base platform during operation. Although a variety of wheels available in the art may adequately function in this regard, the present invention preferably utilizes a wheel having an internal bearing race 52*a* that fulfills to offer smooth operability. In maintaining stability for safe operation, particularly to inhibit vertical lifting of the wheels attached to the lower forward shaft 46 apart from the framed portion of the base platform during occasional rise of the upper platform 26, an open track 54 of the type depicted in FIG. 4 may be mounted to each longitudinal side 24*c* of the framed portion 24*b* of the base platform 24 in such manner to accommodate and partially encapsulate each of the wheels.

Figure 8:
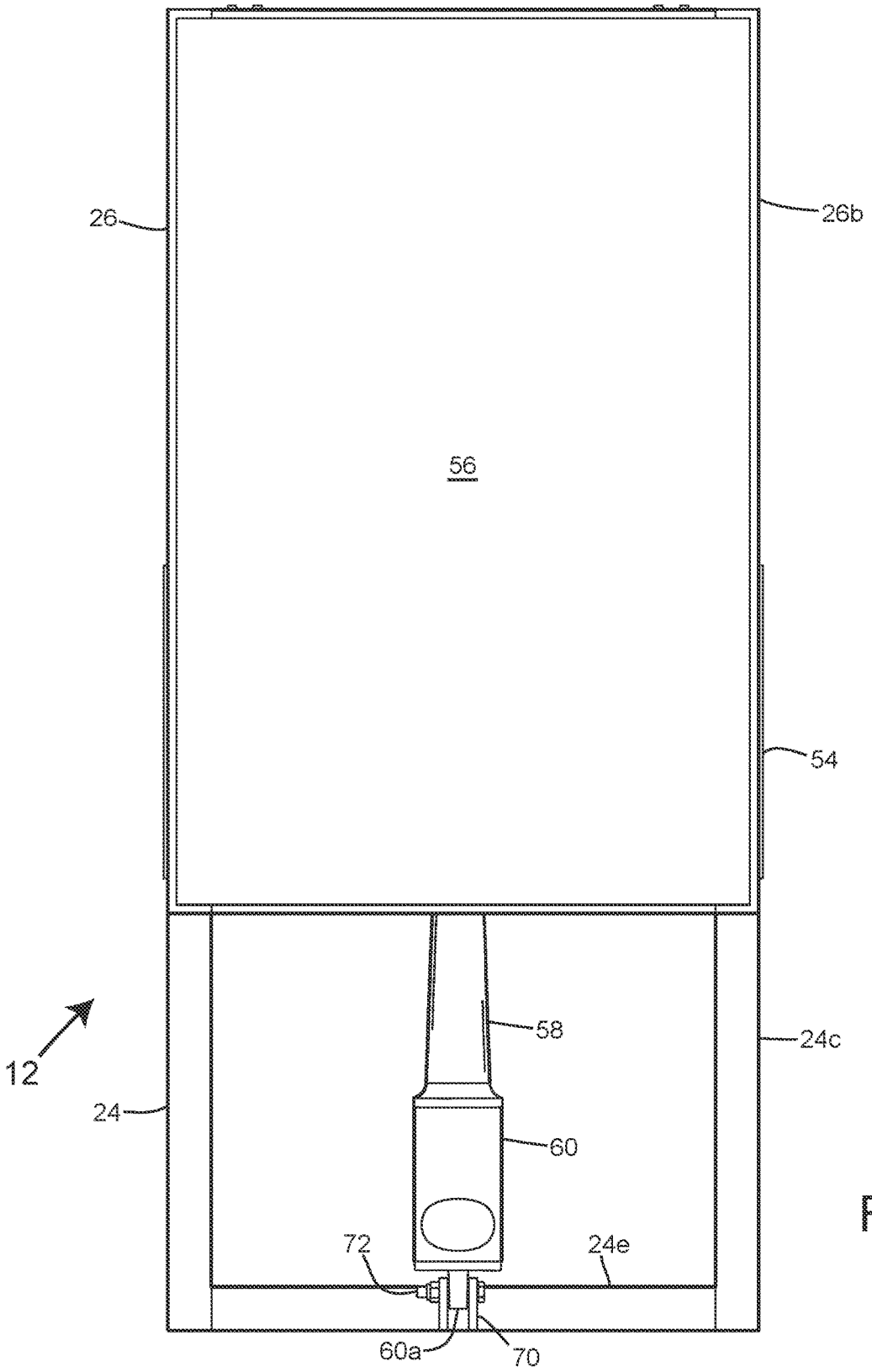
FIG. 8 is a top plan view of the preferred embodiment of the present invention illustrating a linear actuator and an upper platform of a scissor lift configured with a planar surface element.
Figure 9:
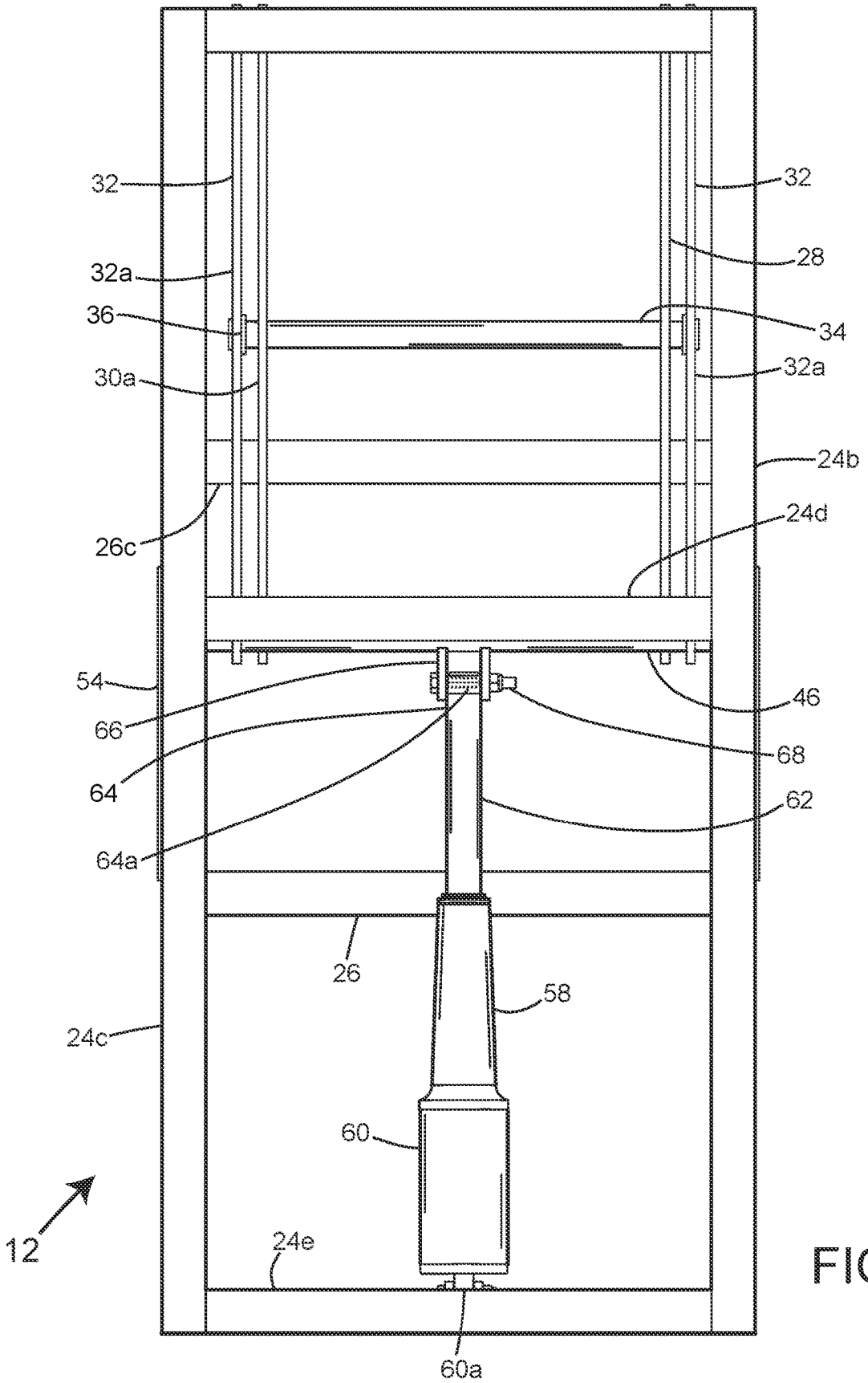
FIG. 9 is a bottom plan view of the preferred embodiment of the present invention illustrating a base platform of a scissor lift and having a framed portion configured with an internal cross support.

As further associated with the scissor lift 12, the upper platform 26 is shown in FIGS. 8 and 9 as comprising an internal cross support 26*c* connecting to the framed portion 26*b* and a planar surface element 56 attached to a top side 26*d* of the framed portion thereof to facilitate support of stowed content and offer an amount of rigidity thereto in such manner to mitigate occurrences of undue racking, while the framed portion 24*b* of the base platform 24 is shown in FIG. 9 as being supplementally configured with an internal cross support 24*d* to the likes of the upper platform.

Now in reference to FIGS. 4 and 9, upward and downward movement of the upper platform relatively to the base platform 24 is advanced by actuator means, preferably a linear actuator 58 of the type commonly known and available in the art to comprise a body 60 having a eyelet end 60*a* and a retractable shaft 62 having an end 64 configured with a throughput bore 64*a* for adaptively attaching to the lower forward shaft 46. A pair of flanges 66 mounted to the lower forward shaft and each being configured with an aperture in alignment with the throughput bore adequately accommodates placement of a bolt 68 or an equivalent type of fastener therewithin to establish a secure relationship thereat.

Comparatively, the eyelet end 60*a* is generally described as being situated in between a pair of flanges 70 extending upwardly from an end member 24*e* of the framed portion of the base platform 24 and is attached thereto by means of a bolt 72 to allow a minute amount of pivotable movement thereabout as the retractable shaft 62 of the linear actuator 58 generally advances outwardly in a horizontal manner against the lower forward shaft 46. Accordingly, as the retractable shaft of the linear actuator continues to advance in this manner, the wheels 52 attached to the lower and upper forward shafts will be set in motion to traverse respectively about and along the framed portions of the base and upper platforms while the upper platform 26 lifts upwardly in the direction of path A in FIG. 5 to receive designated items for placement within the containment enclosure 14. Conversely, retraction of the retractable shaft 62 into the body 60 of the linear actuator 58 moves downward the upper platform to a lowermost position in the direction of path A' in FIG. 5 for purposes generally associated with temporary storage of heavily-weighted items such as a cooler 74 and the like within the containment enclosure 14.

Automated control of the linear actuator to effect upward and downward operation of the scissor lift 12 is facilitated by a controller, which in simplified form comprises an onboard switch 58*a* possessing the capacity to operably energize a motor (not shown) inherently associated with the linear actuator 58 to fulfill controlled movement of the retractable shaft 62. Accordingly, in this regard, a 12V DC power source supplied onboard the watercraft and electrically coupled to the onboard switch and a requisite number of relays (not shown) and ultimately the motor associated with linear actuator may fulfill the operational requirements of the watercraft storage system 10. In more elaborate configurations, it is conceivable within the scope of the present invention that the controller may alternatively comprise wireless means. In this instance, wireless means may employ use of a radio frequency (RF) module configured with a receiver (not shown) generally coupled to the shared power source and the motor of the linear actuator and a hand-held transmitter (not shown) to effect control of the linear actuator via expressed communications with the receiver by the end user. In an alternative configuration, wireless means may comprise conventional use of a Wi-Fi module or a Bluetooth module (not shown) communicatively coupled to a microcontroller (not shown) that enables switching of the power source to the linear actuator remotely with further provisions of being controlled thorough a software application configured for smartphones and the like communicative devices and having an instruction set adaptively suited to fulfill visual operation of the linear actuator 58 with up and down keys and the status of vertical positioning of the upper platform 26 relatively to the base platform as collectively associated with the scissor lift 12, for example.

Although use of the linear actuator 58 has been described for the preferred embodiment of the watercraft storage system 10, actuator means may comprise varied types of actuators conventionally known in the art that categorically use springs, pneumatics or combination thereof to advance the upward and downward movement of the upper platform in the preferred manner denoted herein. In this instance of use, for example, albeit limited in precise control, the non-electronic type of actuator may operably fulfill extension of the retractable shaft 62 by means of supplying air or gas into the body 60, while retraction of the retractable shaft into the body may occur by way of a return spring that effects movement of the upper platform 26 to a lowermost position near the base platform.

Figure 10:
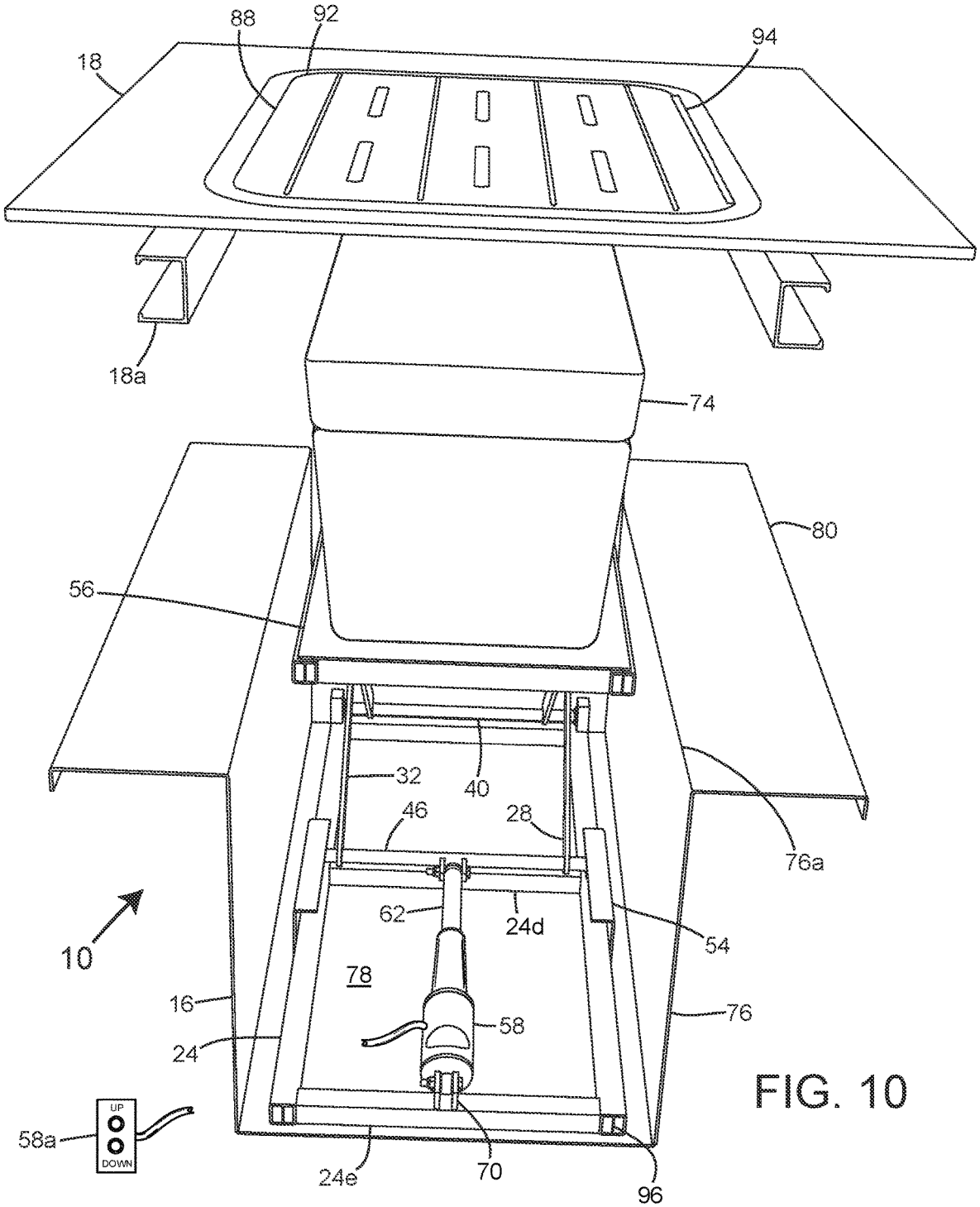
FIG. 10 is a top perspective view of the preferred embodiment of the present invention illustrating an accessible panel fitted within a panel frame for placement above a suspendable shelf adaptively containing a scissor lift for support of a heavily-weighted item such as a cooler.
Figure 11:
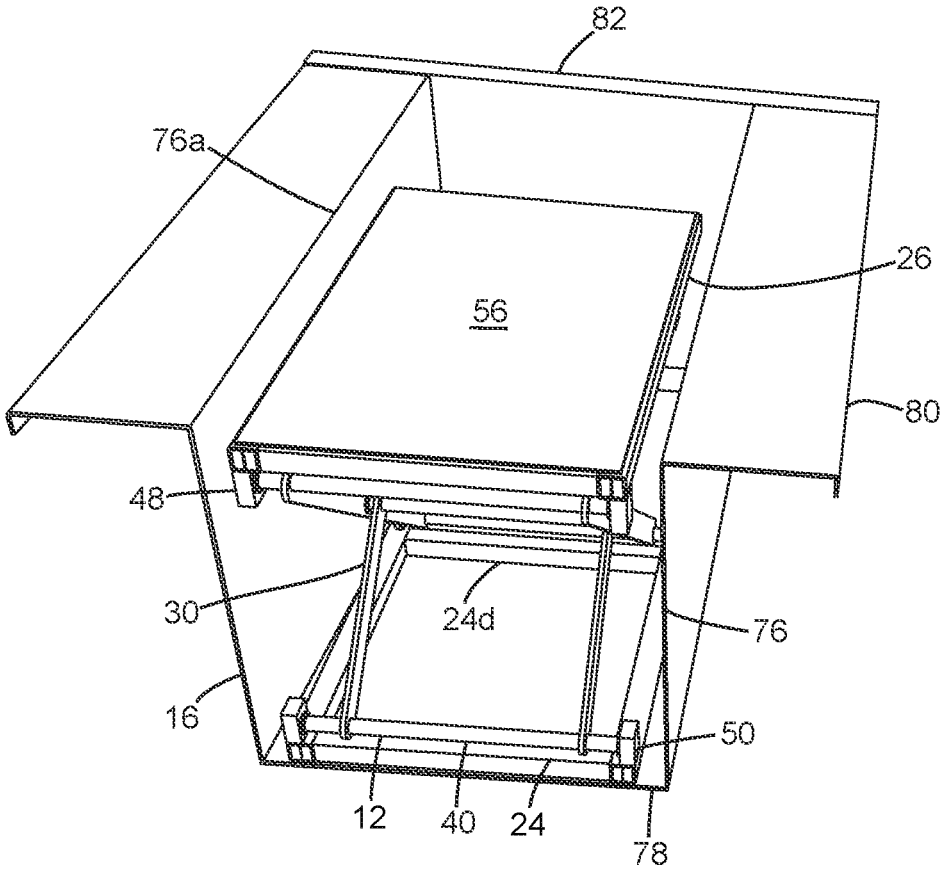
FIG. 11 is a front perspective view of the preferred embodiment of the present invention illustrating a suspendable shelf adaptively configured for receiving and housing a scissor lift and accommodating attachment of one of two end caps.
Figure 12:
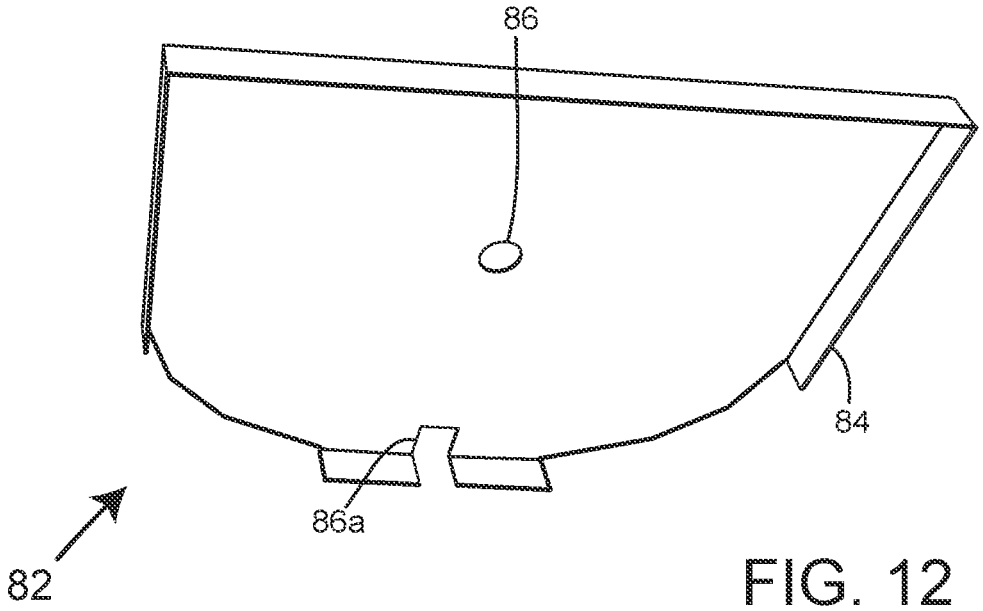
FIG. 12 is a front perspective view of the preferred embodiment of the present invention illustrating an end cap having a mount flange along portions of its perimeter and one or more apertures extending therethrough.

Now in reference to FIGS. 10 and 11, the suspendable shelf 16 is shown therein as comprising a pair of sidewalls 76 substantially existing parallel to one another and being connected to a bottom plate 78 suited to support and accommodate the spatial requirements of the base platform 24 of the scissor lift 12. An upper edge 76*a* of each sidewall is further shown as having a flange 80 extending outwardly therefrom in a perpendicular relation to the sidewall. The flange in this capacity serves as available structure for connecting to the cross beam 18*a* of the floorboard 18 as shown in FIG. 1 or the floorboard itself using conventional methodologies known in the art, such as rivets, bolts, or welds, for example, while allowing the bottom plate of the suspendable shelf 16 to reside relatively above a bottom portion 22*a* of the pontoon's float or boat's hull. Accompanying the sidewalls are a pair of end caps 82 that fully defines the structure of the containment enclosure 14 existing below the watercraft's floorboard. Each end cap, as generally depicted in FIG. 12, comprises a mount flange 84 extending outwardly along portions of the perimeter of the end cap to accommodate attachment to select structural areas of the watercraft, pontoon's float 22 or boat's hull. One or more apertures 86 or cutouts 86*a* may extend through each of the end caps 82 to accommodate select components particularly associated with the watercraft and construct of the pontoon's float or boat's hull, such as electrical lines and the like passing through the aperture and ribbed structural supports fitting within the confines of the cutout.

Figure 3:
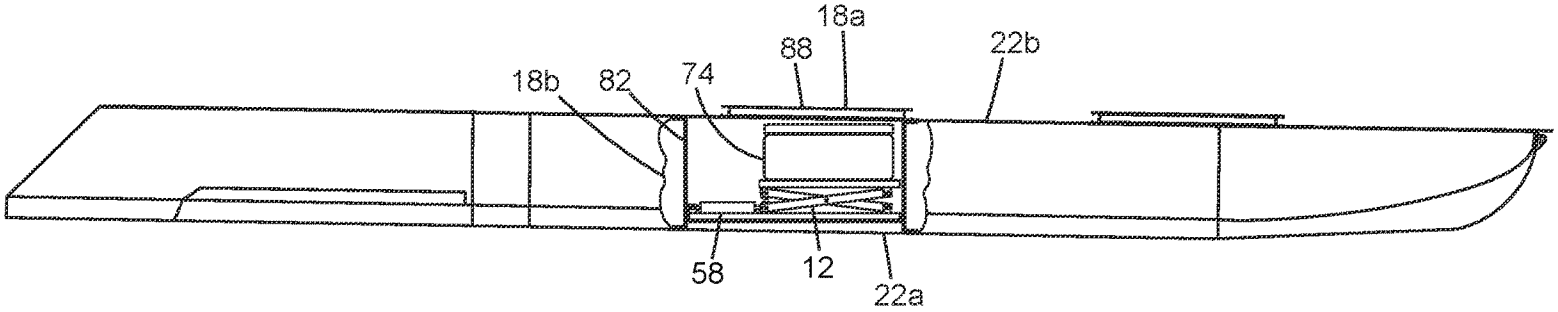
FIG. 3 is a side elevational view of the preferred embodiment of the present invention illustrating a float associated with a pontoon and being equipped with a scissor lift supporting a cooler for storage within a containment enclosure.
Figure 13:
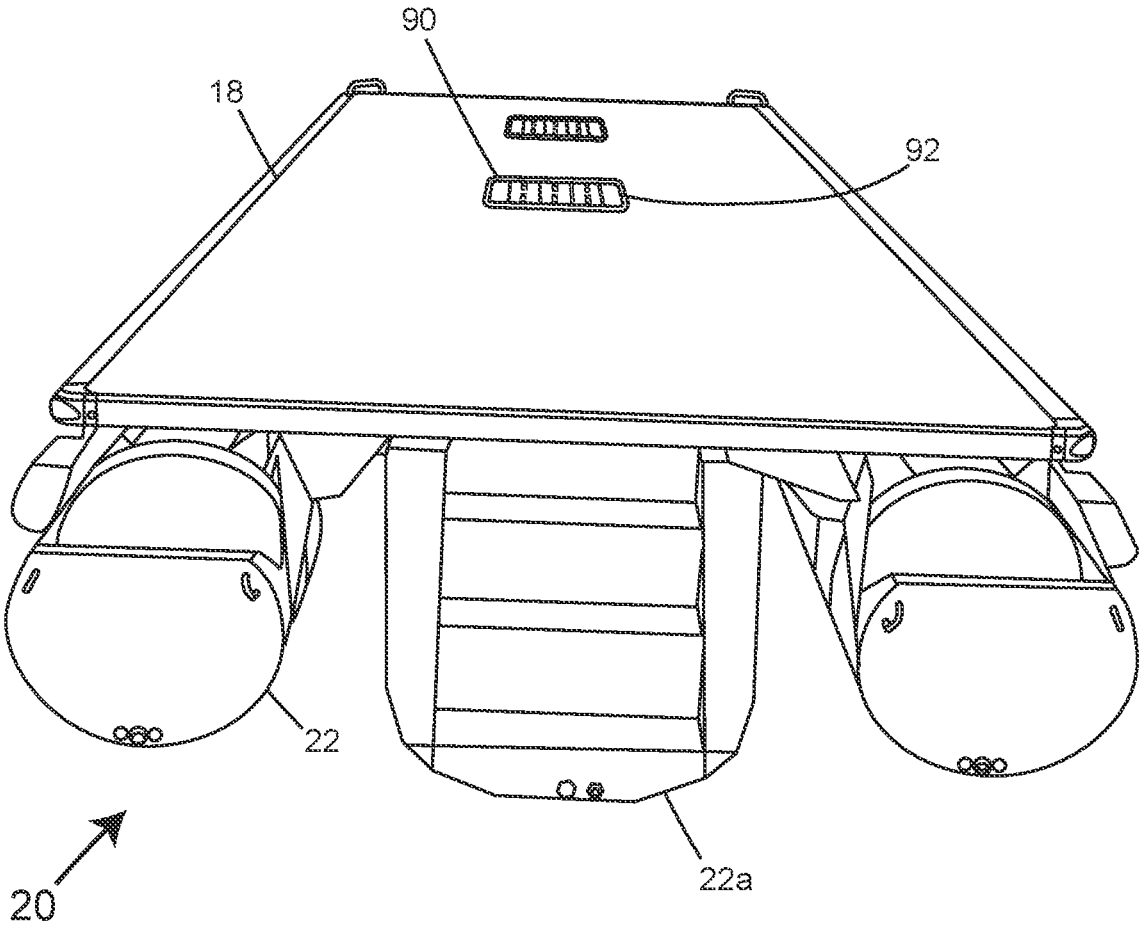
FIG. 13 is an end perspective view of the preferred embodiment of the present invention illustrating a pontoon having a tri-float configuration and a floorboard mounted atop thereof for accommodating one or more accessible panels.

In facilitating access to the containment enclosure existing within the bottom space 18*b* below the watercraft's floorboard 18, the floorboard is shown in FIG. 3 to include a passage cutout 88, which is protectively framed relatively about its perimeter by cross beams 18*a* and a panel frame 90 and covered by an accessible panel 92. In the particular case of pontoons, the passage cutout, while maintaining its geometric relationship, continues to extend through a top side 22*b* portion of the float to fulfill continuity of access to the bottom space and ultimately the containment enclosure 14. The accessible panel in this regard is hinged along one side thereof by means of a piano hinge 94 or equivalent mounted to the panel frame 90 and may be associated with a spring-load mechanism (not shown) that enables auto closure of the accessible panel upon the upper platform 26 being lowered into the containment enclosure 14, particularly in such manner to allow the accessible panel to reside relatively flush or in-line with the watercraft's floorboard for unobstructed foot traffic thereabout, typically in the manner shown in FIG. 13.

As it can be seen from the foregoing there is provided in accordance with this invention a simple and easily assembled watercraft storage system 10 that is particularly suited for adaptation to varied types of watercraft 20 generally having a floorboard 18, such as pontoons and hulled boats.

It is obvious that the components comprising the watercraft storage system 10 may be fabricated from a variety of materials, providing such selection or use of materials possess the capacity to withstand forces acting thereon throughout its duration of use and limit occurrences of premature failure due to sustained exposure to a moisture-laden environment. Accordingly, it is most desirable, and therefore preferred, to construct the watercraft storage system 10, namely, the suspendable shelf 16, end caps 82 and scissor lift 12, from aluminum or an equivalent type of material that meaningfully offer reasonable structural strength for its weight, while limiting the extent by which the components may unacceptably fail due to corrosion. In supplementing strength and offering increased rigidity to the base and upper platforms 24, 26, the respective framed portions 24*b*, 26*b* thereof may be fabricated with an internal rib 96, particularly as configured in FIGS. 6 and 7.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A watercraft storage system comprising:

a containment enclosure, wherein said containment enclosure comprises a suspendable shelf extending downwardly from and connecting to a floorboard of a watercraft, wherein said suspendable shelf comprises a bottom plate and a pair of sidewalls integrally connecting therewith, each of said sidewalls having an upper edge configured with a flange for accommodating attachment to the watercraft, and wherein said containment enclosure comprises a pair of end caps attached to said pair of sidewalls and said bottom plate and each having a mount flange for accommodating attachment to the watercraft;

a scissor lift housed within said containment enclosure and having a base platform configured with a pair of upward mounts, an upper platform configured with a pair of downward mounts, and a pair of moveable supports each having an innermost cross member configured with a first end and a second end and an outermost cross member configured with a first end and a second end;

wherein said scissor lift further comprises:

an upper end shaft having ends engaging with and capable of rotating relatively to said pair of downward mounts;

a lower end shaft having ends engaging with and capable of rotating relatively to said pair of upward mounts;

a lower forward shaft having ends capable of traversing said base platform;

an upper forward shaft having ends capable of traversing said upper platform;

a supportive cross rod being fixedly connected to each of said innermost cross members and having ends each engaging with and capable of rotating relatively to each of said outermost cross members;

an actuator connecting to said base platform and said lower forward shaft for raising and lowering said upper platform relatively to said base platform; and wherein said first ends of the outermost cross members and said first ends of the innermost cross members respectively attach to said upper end shaft and said lower end shaft and said second ends of the outermost cross members and said second ends of the innermost cross members respectively attach to said lower forward shaft and said upper forward shaft.

2. The watercraft storage system as set forth in claim 1, wherein said actuator comprises a linear actuator having an eyelet end for mating with flanges of the base platform and accommodating a fastener and a retractable shaft having an end configured with a throughput bore for mating with flanges of the lower forward shaft and accommodating a fastener.

3. The watercraft storage system as set forth in claim 2, wherein said linear actuator is operably controlled by a controller for extending and retracting said retractable shaft.

4. The watercraft storage system as set forth in claim 3, wherein said controller comprises an onboard switch communicatively coupled to said linear actuator.

5. The watercraft storage system as set forth in claim 1, wherein said upward mounts and said downward mounts each comprises a cylindrical bore press-fitted with a bushing for respectively accommodating said ends of the lower end shaft and said ends of the upper end shaft.

6. The watercraft storage system as set forth in claim 1, wherein said ends of the lower forward shaft and upper forward shaft each comprises a wheel attached thereto.

7. The watercraft storage system as set forth in claim 6, wherein said scissor lift comprises a pair of open tracks mounted to said base platform for accommodating therewithin said wheels of the lower forward shaft.

8. The watercraft storage system as set forth in claim 1, further comprising an accessible panel for fitting over a passage cutout extending through a watercraft's floorboard for accessing said scissor lift housed within said containment enclosure.

9. The watercraft storage system as set forth in claim 1, wherein said upper platform comprises a framed portion and a planar surface element positioned atop of and mounted to said framed portion.

10. The watercraft storage system as set forth in claim 1, wherein each of said outermost cross members comprises an aperture extending therethrough and a bushing fitted therewithin for accommodating each of said ends of the supportive cross rod.

11. A watercraft storage system for watercraft having a floorboard, said watercraft storage system comprising:

a suspendable shelf having a bottom plate and a pair of sidewalls integrally connecting therewith;

a pair of end caps fixedly attached to said bottom plate and said pair of sidewalls of the suspendable shelf to form a containment enclosure, each of said sidewalls having an upper edge configured with a flange for accommodating attachment to the watercraft;

a scissor lift supported by said suspendable shelf and having a base platform configured with a pair of upward mounts, an upper platform configured with a pair of downward mounts, and a pair of moveable supports each having an innermost cross member configured with a midpoint position, a first end, and a second end and an outermost cross member configured with a midpoint position, a first end, and a second end; wherein said scissor lift further comprises:

an upper end shaft having ends engaging with and capable of rotating relatively to said pair of downward mounts;

a lower end shaft having ends engaging with and capable of rotating relatively to said pair of upward mounts;

a lower forward shaft having ends each being fitted with a wheel for traversing said base platform;

an upper forward shaft having ends each being fitted with a wheel for traversing said upper platform;

a supportive cross rod being fixedly connected to said midpoint position of each of the innermost cross members and having ends each engaging with and capable of rotating relatively to said midpoint position of each of the outermost cross members;

a linear actuator connecting to said base platform and said lower forward shaft for raising and lowering said upper platform relatively to said base platform; and wherein said first ends of the outermost cross members and said first ends of the innermost cross members respectively attach to said upper end shaft and said lower end shaft and said second ends of the outermost cross members and said second ends of the innermost cross members respectively attach to said lower forward shaft and said upper forward shaft.

12. The watercraft storage system as set forth in claim 11, wherein said upward mounts and said downward mounts each comprises a cylindrical bore press-fitted with a bushing for respectively accommodating each of said ends of the lower end shaft and each of said ends of the upper end shaft.

13. The watercraft storage system as set forth in claim 11, wherein said scissor lift comprises a pair of open tracks mounted to said base platform for accommodating therewithin said wheels of the lower forward shaft.

14. The watercraft storage system as set forth in claim 11, further comprising an accessible panel for fitting over a passage cutout extending through the watercraft's floorboard for accessing said scissor lift while being supported by said suspendable shelf.

* * * * *